US009294839B2

(12) United States Patent
Lambert et al.

(10) Patent No.: US 9,294,839 B2
(45) Date of Patent: Mar. 22, 2016

(54) AUGMENTATION OF A BEAMFORMING MICROPHONE ARRAY WITH NON-BEAMFORMING MICROPHONES

(71) Applicant: ClearOne Inc., Salt Lake City, UT (US)

(72) Inventors: David K. Lambert, South Jordan, UT (US); Russell S. Ericksen, Spanish Fork, UT (US); Derek Graham, South Jordan, UT (US)

(73) Assignee: ClearOne, Inc., Salt Lake City, UT (US)

( * ) Notice: Subject to any disclaimer, the term of this patent is extended or adjusted under 35 U.S.C. 154(b) by 126 days.

(21) Appl. No.: 14/276,438

(22) Filed: May 13, 2014

(65) Prior Publication Data

US 2014/0341392 A1 Nov. 20, 2014

Related U.S. Application Data

(63) Continuation of application No. 14/191,511, filed on Feb. 27, 2014, now abandoned.

(60) Provisional application No. 61/771,751, filed on Mar. 1, 2013, provisional application No. 61/828,524, filed on May 29, 2013.

(51) Int. Cl.

| | |
|---|---|
| ***H04R 3/00*** | (2006.01) |
| ***H04R 1/08*** | (2006.01) |
| ***H04R 17/02*** | (2006.01) |
| ***H04R 1/40*** | (2006.01) |

(52) U.S. Cl.
CPC ..... *H04R 3/005* (2013.01); *H04R 1/08* (2013.01); *H04R 1/406* (2013.01); *H04R 17/02* (2013.01); *H04R 2430/23* (2013.01)

(58) Field of Classification Search
None
See application file for complete search history.

(56) References Cited

U.S. PATENT DOCUMENTS

| | | | | |
|---|---|---|---|---|
| 8,229,134 | B2 | 7/2012 | Duraiswami et al. | |
| 2013/0343549 | A1 * | 12/2013 | Vemireddy | H04R 5/027 381/17 |

* cited by examiner

*Primary Examiner* — Curtis Kuntz
*Assistant Examiner* — Kenny Truong
(74) *Attorney, Agent, or Firm* — Matthew J. Booth & Associates PLLC; Matthew J. Booth

(57) ABSTRACT

Embodiments of the present disclosure include an apparatus (116) configured to perform beamforming on multiple audio input signals. The apparatus (116) includes a first plurality of microphones (302, 502) configured to resolve first audio input signals within a first frequency range. The apparatus (116) also includes at least one microphone (504) configured to resolve second audio input signals within a second frequency range. A lowest frequency in the first frequency range is greater than a lowest frequency in the second frequency range.

20 Claims, 7 Drawing Sheets

AUGMENTATION OF A BEAMFORMING MICROPHONE ARRAY WITH NON-BEAMFORMING MICROPHONES

CROSS REFERENCE TO RELATED APPLICATIONS

This application claims priority and the benefits of the earlier filed Provisional U.S. AN 61/771,751, filed 1 Mar. 2013, which is incorporated by reference for all purposes into this specification.

This application claims priority and the benefits of the earlier filed Provisional U.S. AN 61/828,524, filed 29 May 2013, which is incorporated by reference for all purposes into this specification.

Additionally, this application is a continuation of U.S. application Ser. No. 14/191,511, filed 27 Feb. 2014, which is incorporated by reference for all purposes into this specification.

TECHNICAL FIELD

This disclosure relates to microphone arrays, more specifically to beamforming microphone arrays.

BACKGROUND ART

Individual microphone elements designed for far field audio use can be characterized, in part, by their pickup pattern. The pickup pattern describes the ability of a microphone to reject noise and indirect reflected sound arriving at the microphone from undesired directions. The most popular microphone pickup pattern for use in audio conferencing applications is the cardiod pattern. Other patterns include supercardiod, hypercardiod, and bidirectional.

In a beamforming microphone array designed for far field use, a designer chooses the spacing between microphones to enable spatial sampling of a traveling acoustic wave. Signals from the array of microphones are combined using various algorithms to form a desired pickup pattern. If enough microphones are used in the array, the pickup pattern may yield improved attenuation of undesired signals that propagate from directions other than the "direction of look" of a particular beam in the array.

For use cases in which a beamformer is used for room audio conferencing, audio streaming, audio recording, and audio used with video conferencing products, it is desirable for the beamforming microphone array to capture audio containing frequency information that spans the full range of human hearing. This is generally accepted to be 20 Hz to 20 kHz.

Some beamforming microphone arrays are designed for "close talking" applications, like a mobile phone handset. In these applications, the microphone elements in the beamforming array are positioned within a few centimeters, to less than one meter, of the talker's mouth during active use. The main design objective of close talking microphone arrays is to maximize the quality of the speech signal picked up from the direction of the talker's mouth while attenuating sounds arriving from all other directions. Close talking microphone arrays are generally designed so that their pickup pattern is optimized for a single fixed direction.

Problems with the Prior Art

It is well known by those of ordinary skill in the art that the closest spacing between microphones restricts the highest frequency that can be resolved by the array and the largest spacing between microphones restricts the lowest frequency that can be resolved. At a given temperature and pressure in air, the relationship between the speed of sound, its frequency, and its wavelength is $c=\lambda v$ where c is the speed of sound, $\lambda$ is the wavelength of the sound, and v is the frequency of the sound.

For professionally installed conferencing applications, it is desirable for a microphone array to have the ability to capture and transmit audio throughout the full range of human hearing that is generally accepted to be 20 Hz to 20 kHz. The low frequency design requirement presents problems due to the physical relationship between the frequency of sound and its wavelength given by the simple equation in the previous paragraph. For example, at 20 degrees Celsius (68 degrees Fahrenheit) at sea level, the speed of sound in dry air is 340 meters per second. In order to perform beamforming down to 20 Hz, the elements of a beamforming microphone array would need to be 340/20=17 meters (55.8 feet) apart. A beamforming microphone this long would be difficult to manufacture, transport, install, and service. It would also not be practical in most conference rooms used in normal day-to-day business meetings in corporations around the globe.

The high frequency requirement for professional installed applications also presents a problem. Performing beamforming for full bandwidth audio may require significant computing resources including memory and CPU cycles, translating directly into greater cost.

It is also generally known to those of ordinary skill in the art that in most conference rooms, low frequency sound reverberates more than high frequency sound. One well-known acoustic property of a room is the time it takes the power of a sound impulse to be attenuated by 60 Decibels (dB) due to absorption of the sound pressure wave by materials and objects in the room. This property is called RT60 and is measured as an average across all frequencies. Rather than measuring the time it takes an impulsive sound to be attenuated, the attenuation time at individual frequencies can be measured. When this is done, it is observed that in most conference rooms, lower frequencies, (up to around 4 kHz) require a longer time to be attenuated by 60 dB as compared to higher frequencies (between around 4 kHz and 20 kHz).

SUMMARY OF INVENTION

This disclosure describes augmentation of a beamforming microphone array with non-beamforming microphones. One exemplary embodiment of the present disclosure includes a system for beamforming of audio input signals. The system may include a plurality of first microphones configured to resolve first audio input signals within a first frequency range, and at least one second microphone configured to resolve second audio input signals within a second frequency range. The first frequency range may have a lowest frequency greater than a lowest frequency of the second frequency range. The system may further include a noise gating module for receiving the second audio input signals. The noise gating module may be configured to restrict the second audio input signals within a restricted second frequency range, where the restricted second frequency range may extend (1) between the lowest frequency of the second frequency range and the lowest frequency of the first frequency range, or (2) between the highest frequency of the second frequency range and the highest frequency of the first frequency range. The system may also include an augmented beamforming module configured to (1) receive the restricted second audio input signals and the first audio input signals and (2) perform beamforming on the received first audio input signals and the restricted second audio input signals within a bandpass frequency range, where the bandpass frequency range can be a combination of the first frequency range and the restricted second frequency range.

In one aspect of the system, the plurality of first microphones are arranged linearly.

In another aspect of the system, the plurality of first microphones are unidirectional.

In yet another aspect of the system, the at least one second microphone is omnidirectional.

In still another aspect of the system, the plurality of first microphones and the at least one second microphone operate within a low frequency range.

A further aspect of the system includes that the bandpass frequency range is the human hearing frequency range.

In another aspect of the system, the at least one second microphone is a cardioid microphone.

Yet another aspect of the system, includes that the at least one second microphone is oriented to point outwards.

In still another aspect of the system, at least one third microphone is configured to resolve third audio input signals within a second frequency range, such that the at least one second microphone and the at least one third microphone are arranged on opposite ends of the plurality of first microphones.

Other and further aspects and features of the disclosure will be evident from reading the following detailed description of the embodiments, which are intended to illustrate, not limit, the present disclosure.

BRIEF DESCRIPTION OF DRAWINGS

To further aid in understanding the disclosure, the attached drawings help illustrate specific features of the disclosure and the following is a brief description of the attached drawings.

DISCLOSURE OF EMBODIMENTS

This disclosure describes augmentation of a beamforming microphone array with non-beamforming microphones. This disclosure describes numerous specific details in order to provide a thorough understanding of the present invention. One ordinarily skilled in the art will appreciate that one may practice the present invention without these specific details. Additionally, this disclosure does not describe some well-known items in detail in order not to obscure the present invention.

Non-Limiting Definitions

In various embodiments of the present disclosure, definitions of one or more terms that will be used in the document are provided below.

A "beamforming microphone" is used in the present disclosure in the context of its broadest definition. The beamforming microphone may refer to a microphone configured to resolve audio input signals over a narrow frequency range received from a particular direction.

A "non-beamforming microphone" is used in the present disclosure in the context of its broadest definition. The non-beamforming microphone may refer to a microphone configured to resolve audio input signals over a broad frequency range received from multiple directions.

The numerous references in the disclosure to a band-limited beamforming microphone array are intended to cover any and/or all devices capable of performing respective operations in the applicable context, regardless of whether or not the same are specifically provided.

Detailed Description of the Invention follows.

Figure 1A:
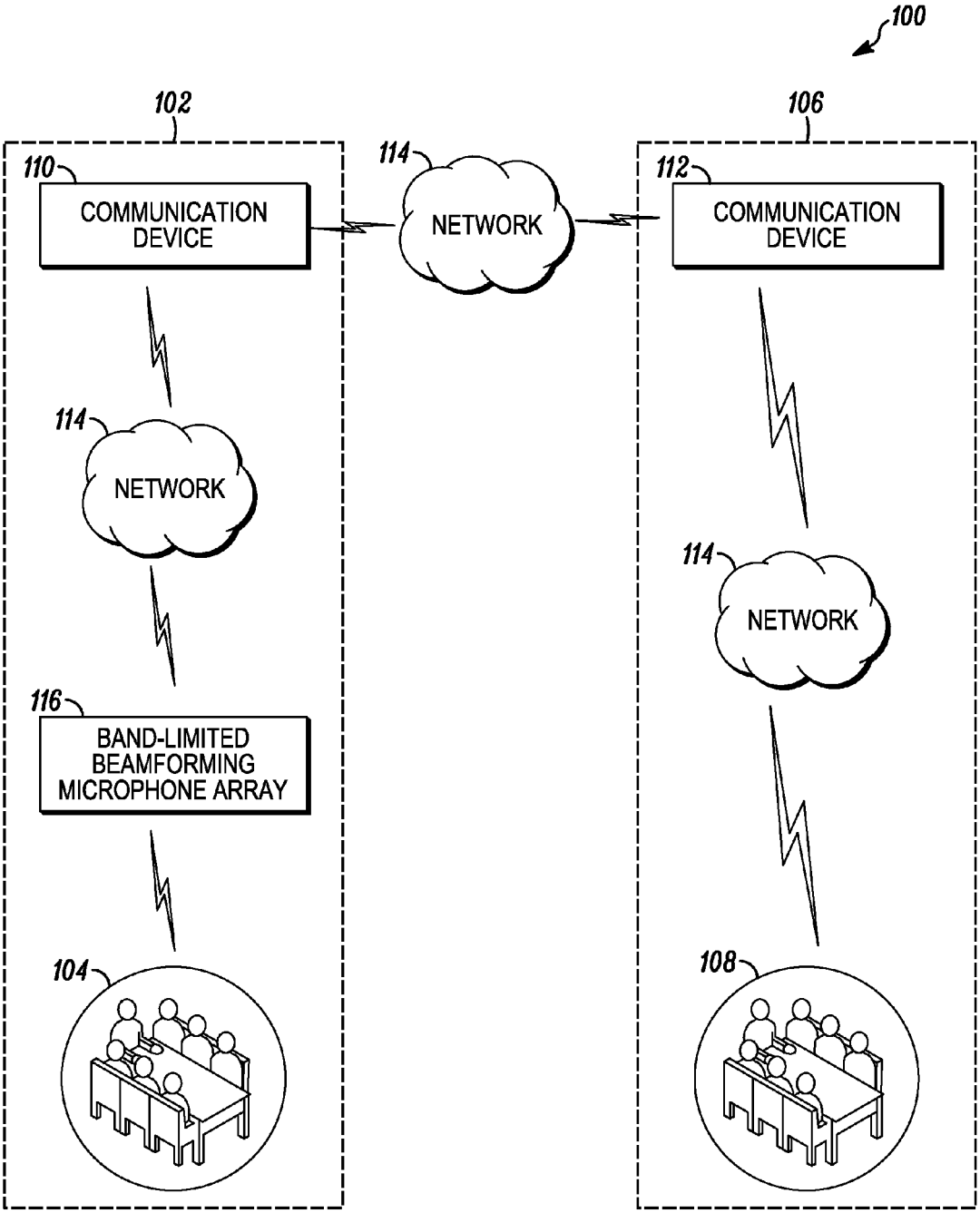
FIGS. 1A and 1B are schematics that illustrate environments for implementing an exemplary band-limited beamforming microphone array, according to some exemplary embodiments of the present disclosure.
Figure 1B:
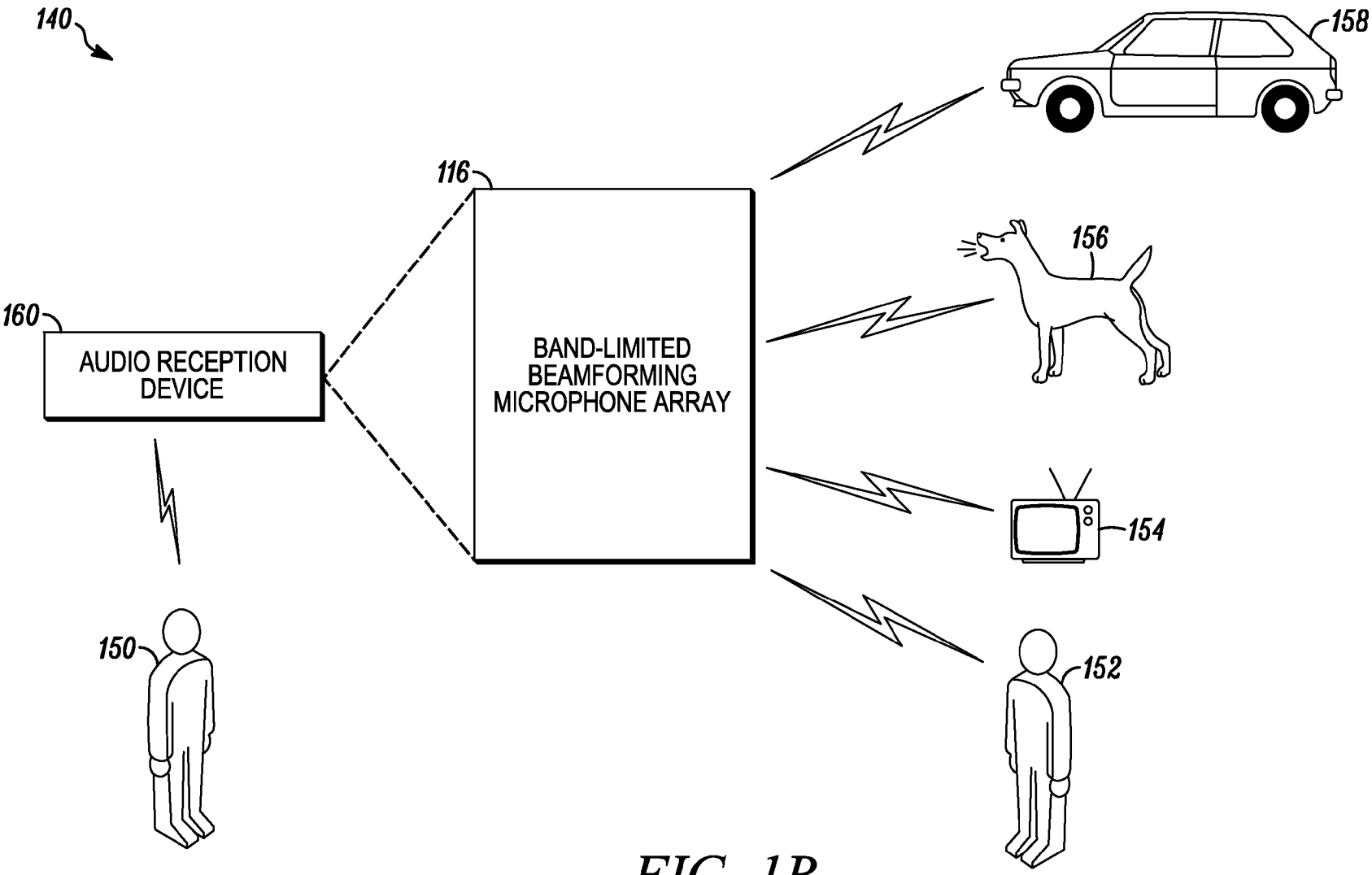

FIGS. 1A and 1B are schematics that illustrate environments for implementing an exemplary band-limited beamforming microphone array, according to some exemplary embodiments of the present disclosure. Embodiment shown in FIG. 1 illustrates a first environment 100 (for e.g., audio conferencing, video conferencing, etc.) that involves interaction between multiple users located within one or more substantially enclosed areas, for e.g., a room. The first environment 100 may include a first location 102 having a first set of users 104 and a second location 106 having a second set of users 108. The first set of users 104 may communicate with the second set of users 108 using a first communication device 110 and a second communication device 112 respectively over a network 114. The first communication device 110 and the second communication device 112 may be implemented as any of a variety of computing devices (for e.g., a server, a desktop PC, a notebook, a workstation, a personal digital assistant (PDA), a mainframe computer, a mobile computing device, an internet appliance, etc.) and calling devices (for e.g., a telephone, an internet phone, etc.). The first communication device 110 may be compatible with the second communication device 112 to exchange audio input signals with each other or any other compatible devices.

The disclosed embodiments may involve transfer of data, for e.g., audio data, over the network 114. The network 114 may include, for example, one or more of the Internet, Wide Area Networks (WANs), Local Area Networks (LANs), analog or digital wired and wireless telephone networks (e.g., a PSTN, Integrated Services Digital Network (ISDN), a cellular network, and Digital Subscriber Line (xDSL)), radio, television, cable, satellite, and/or any other delivery or tunneling mechanism for carrying data. Network 114 may include multiple networks or sub-networks, each of which may include, for example, a wired or wireless data pathway. The network 114 may include a circuit-switched voice network, a packet-switched data network, or any other network able to carry electronic communications. For example, the network 114 may include networks based on the Internet protocol (IP) or asynchronous transfer mode (ATM), and may support voice using, for example, VoIP, Voice-over-ATM, or other comparable protocols used for voice data communications. Other embodiments may involve the network 114 including a cellular telephone network configured to enable exchange of text or multimedia messages.

The first environment may also include a band-limited beamforming microphone array 116 (hereinafter referred to as band-limited array 116) interfacing between the first set of users 104 and the first communication device 110 over the network 114. The band-limited array 116 may include multiple microphones for converting ambient sounds (such as voices or other sounds) from various sound sources (such as the first set of users 104) at the first location 102 into audio input signals. In an embodiment, the band-limited array 116 may include a combination of beamforming microphones (BFMs) and non-beamforming microphones (NBMs). The BFMs may be configured to capture the audio input signals (BFM signals) within a first frequency range, and the NBMs (NBM signals) may be configured to capture the audio input signals within a second frequency range.

The band-limited array 116 may transmit the captured audio input signals to the first communication device 110 for processing and transmit the processed captured audio input signals to the second communication device 112. In an embodiment, the first communication device 110 may be configured to perform augmented beamforming within an intended bandpass frequency window using a combination of BFMs and one or more NBMs. For this, the first communication device 110 may be configured to combine band-limited NBM signals to the BFM signals to perform beamforming within the bandpass frequency window, discussed later in greater detail, by applying one or more of various beamforming algorithms, such as, delay and sum algorithm, filter sum algorithm, etc. known in the art, related art or developed later. The bandpass frequency window may be a combination of the first frequency range corresponding to the BFMs and the band-limited second frequency range corresponding to the NBMs.

Unlike conventional beamforming microphone arrays, the band-limited array 116 has better directionality and performance due to augmented beamforming of the audio input signals within the bandpass frequency window. In one embodiment, the first communication device 110 may configure the desired bandpass frequency range to the human hearing frequency range (i.e., 20 Hz to 20 KHz); however, one of ordinary skill in the art may predefine the bandpass frequency window based on an intended application. In some embodiments, the band-limited array 116 in association with the first communication device 110 may be additionally configured with adaptive steering technology known in the art, related art, or developed later for better signal gain in a specific direction towards an intended sound source, for e.g., at least one of the first set of users 104.

The first communication device 110 may transmit one or more augmented beamforming signals within the bandpass frequency window to the second set of users 108 at the second location 106 via the second communication device 112 over the network 114. In some embodiments, the band-limited array 116 may be integrated with the first communication device 110 to form a band-limited communication system. Such system or the first communication device 110, which is configured to perform beamforming, may be implemented in hardware or a suitable combination of hardware and software, and may include one or more software systems operating on a digital signal processing platform. The "hardware" may include a combination of discrete components, an integrated circuit, an application-specific integrated circuit, a field programmable gate array, a digital signal processor, or other suitable hardware. The "software" may include one or more objects, agents, threads, lines of code, subroutines, separate software applications, two or more lines of code or other suitable software structures operating in one or more software applications or on one or more processors.

As shown in FIG. 1B, a second exemplary environment 140 (for e.g., public surveillance, song recording, etc.) may involve interaction between a user and multiple entities located at open surroundings, like a playground. The second environment 140 may include a user 150 receiving sounds from various sound sources, such as, a second person 152 or a group of persons, a television 154, an animal such as a dog 156, transportation vehicles such as a car 158, etc., present in the open surroundings via an audio reception device 160. The audio reception device 160 may be in communication with, or include, the band-limited array 116 configured to perform beamforming on audio input signals based on the sounds received from various entities behaving as sound sources, such as those mentioned above, within the predefined bandpass frequency window. The audio reception device 160 may be a wearable device which may include, but are not limited to, a hearing aid, a hand-held baton, a body clothing, eyeglass frames, etc., which may be generating the augmented beamforming signals within the bandpass frequency window, such as the human hearing frequency range.

Figure 2:
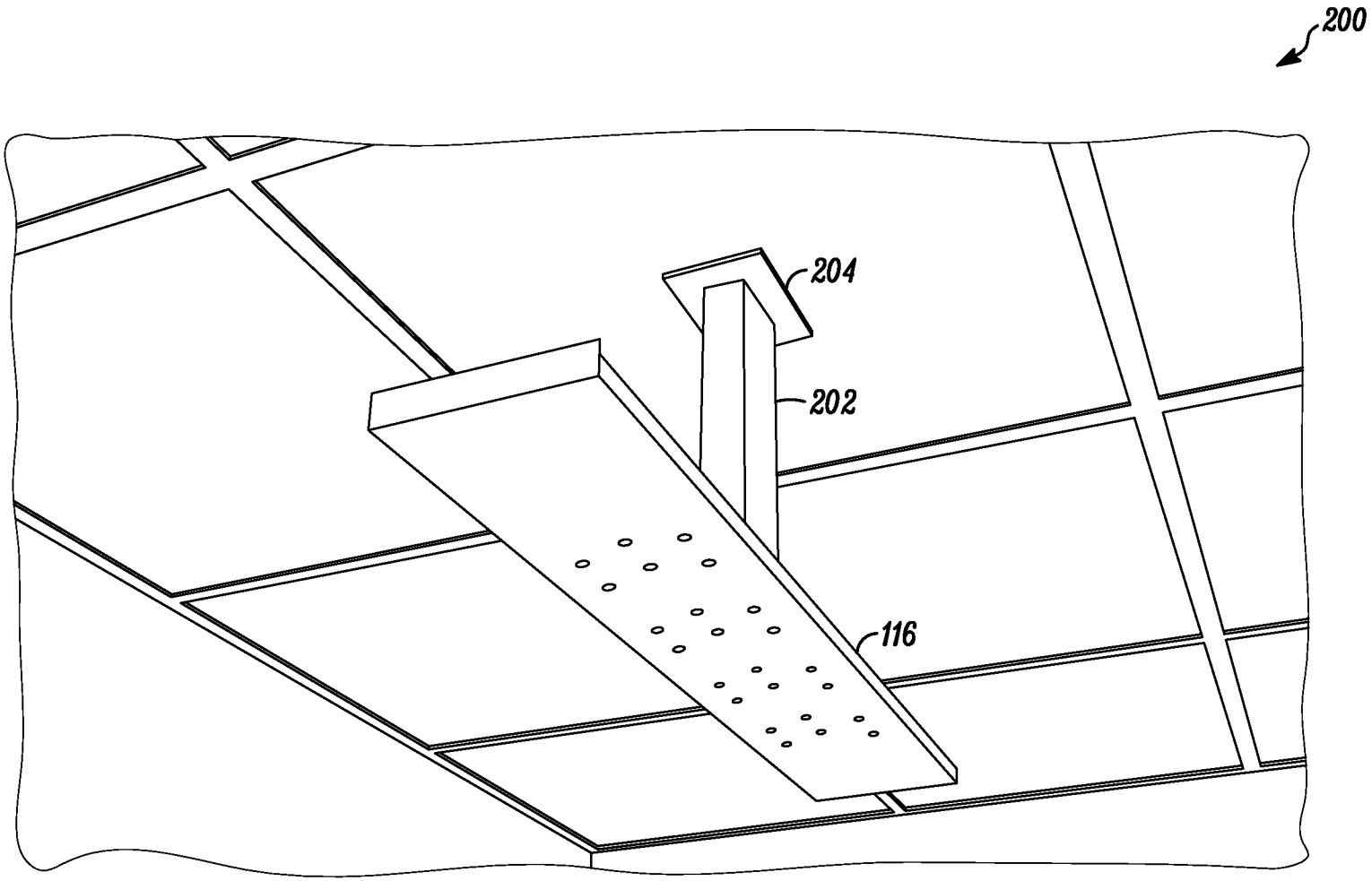
FIG. 2 is a perspective view of the band-limited beamforming microphone array of FIG. 1, according to an embodiment of the present disclosure.

FIG. 2 is a perspective view 200 of the band-limited beamforming microphone array of FIG. 1, according to an embodiment of the present disclosure. The band-limited array 116 may be configured and arranged into various usage configurations, such as drop-ceiling mounting, wall mounting, wall mounting, etc. As shown, the band-limited array 116 may be configured and arranged to a ceiling mounted configuration, in which the band-limited array 116 may be associated with a spanner post 202 inserted into a ceiling mounting plate 204 configured to be in contact with a ceiling 206. In general, the band-limited array 116 may be suspended from the ceiling 206, such that the audio input signals are received by one or more microphones in the band-limited array 116 from above an audio source, such as one of the first set of users 104. The band-limited array 116, the spanner post 202, and the ceiling mounting plate 204 may be appropriately assembled together using various fasteners such as screws, rivets, etc. known in the art, related art, or developed later. The band-limited array 116 may be associated with additional mounting and installation tools and parts including, but not limited to, position clamps, support rails (for sliding the band-limited array 116 in a particular axis), array mounting plate, etc. that are well known in the art and may be understood by a person skilled in the art; and hence, these tools and parts are not discussed in detail herein.

Figure 3:
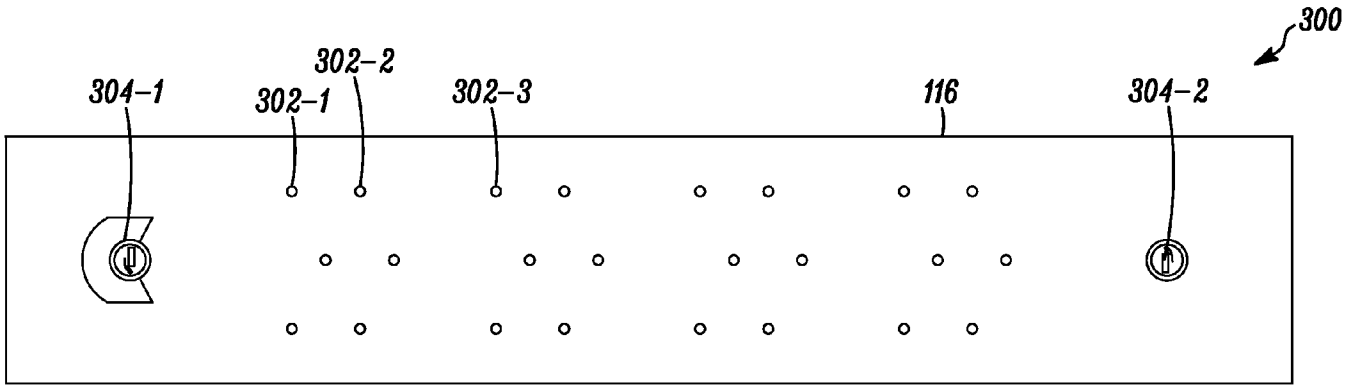
FIG. 3 is a schematic view that illustrates a front side of the exemplary band-limited beamforming microphone array of FIG. 1, according to an embodiment of the present disclosure.

FIG. 3 is a schematic view that illustrates a first side 300 of the exemplary band-limited beamforming microphone array of FIG. 1, according to an embodiment of the present disclosure. At the first side 300, the band-limited array 116 may include multiple BFMs and NBMs (not shown). The BFMs 302-1, 302-2, 302-3, **302-*n* (collectively, BFMs 302) may be arranged in a specific pattern that facilitates maximum directional coverage of various sound sources in the ambient surrounding. In an embodiment, the band-limited array 116 may include twenty four BFMs 302 operating in a frequency range 150 Hz to 16 KHz. Multiple BFMs 302 offer narrow beamwidth of a main lobe on a polar plot in the direction of a particular sound source and improve directionality or gain in that direction. The spacing between each pair of the BFMs 302 may be less than half of the wavelength of sound intended to be received from a particular direction. Above this spacing, the directionality of the BFMs 302 may be reduced and large side lobes begin to appear in the energy pattern on the polar plot in the direction of the sound source. The side lobes indicate alternative directions from where the BFMs 302 may pick-up noise, thereby reducing the directionality of the BFMs 302** in the direction of the sound source.

The BFMs 302 may be configured to convert the received sounds into audio input signals within the operating frequency range of the BFMs 302. Beamforming may be used to point the BFMs 302 at a particular sound source to reduce interference and improve quality of the received audio input signals. The band-limited array 116 may optionally include a user interface having various elements (for e.g., joystick, button pad, group of keyboard arrow keys, a digitizer screen, a touchscreen, and/or similar or equivalent controls) configured to control the operation of the band-limited array 116 based on a user input. In some embodiments, the user interface may include buttons 304-1 and 304-2 (collectively, buttons 304), which upon being activated manually or wirelessly may adjust the operation of the BFMs 302 and the NBMs. For example, the buttons 304-1 and 304-2 may be pressed manually to mute the BFMs 302 and the NBMs, respectively. The elements such as the buttons 304 may be represented in different shapes or sizes and may be placed at an accessible place on the band-limited array 116. As shown, the buttons 304 may be circular in shape and positioned at opposite ends of the linear band-limited array 116 on the first side 300.

Some embodiments of the user interface may include different numeric indicators, alphanumeric indicators, or non-alphanumeric indicators, such as different colors, different color luminance, different patterns, different textures, different graphical objects, etc. to indicate different aspects of the band-limited array 116. In one embodiment, the buttons 304-1 and 304-2 may be colored red to indicate that the respective BFMs 302 and the NBMs are mute.

Figure 4A:
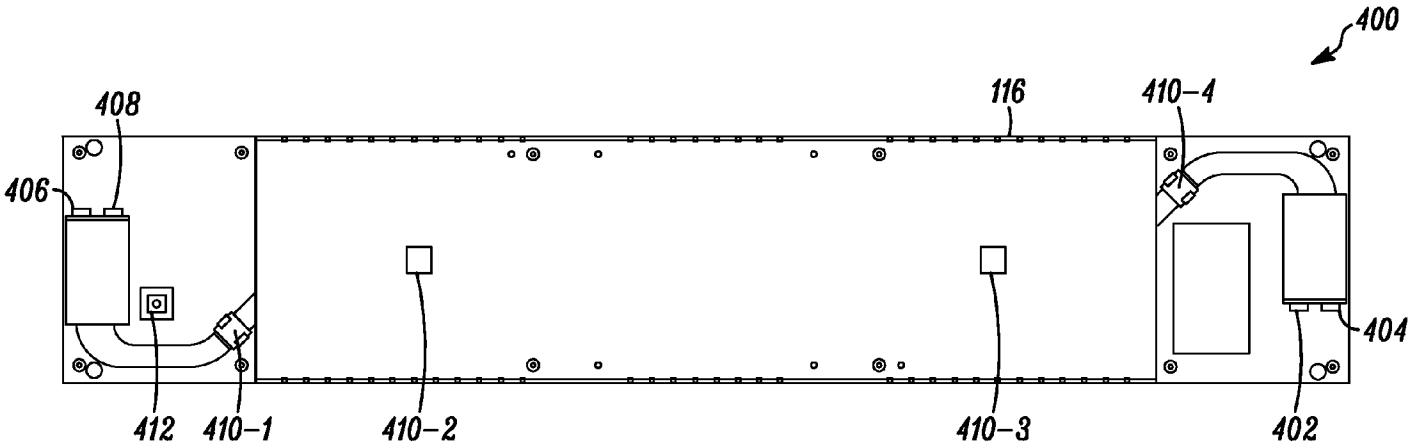
FIG. 4A is a schematic view that illustrates a back side of the exemplary band-limited beamforming microphone array of FIG. 1, according to an embodiment of the present disclosure.
Figure 4B:
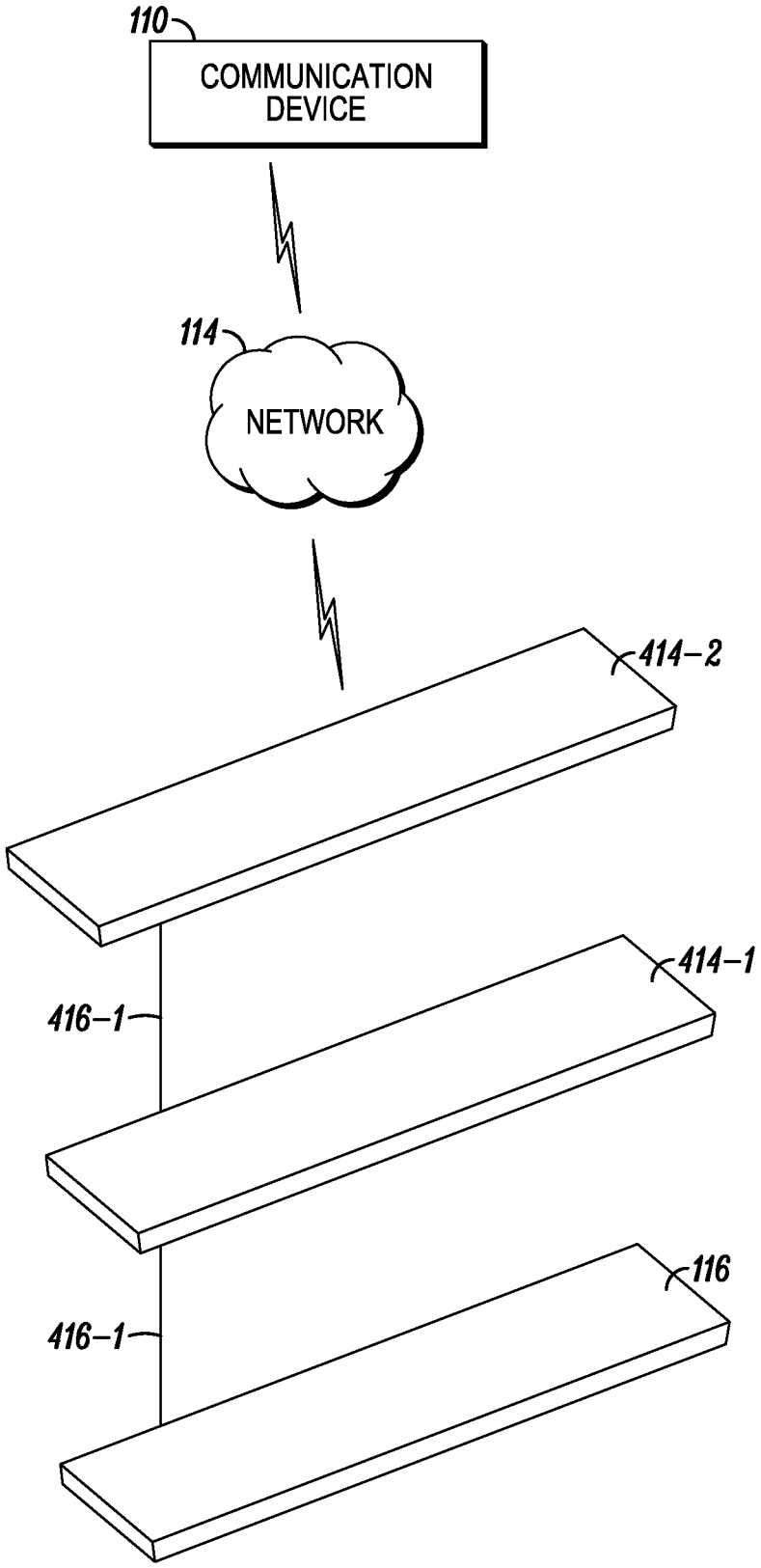
FIG. 4B is a schematic view that illustrates a multiple exemplary band-limited beamforming microphone arrays of FIG. 1 connected to each other, according to an embodiment of the present disclosure.

FIG. 4 is a schematic view that illustrates a second side 400 of the exemplary band-limited beamforming microphone array of FIG. 1, according to an embodiment of the present disclosure. At the second side 400, the band-limited array 116 may include a link-in electronic bus (E-bus) connection 402, a link-out E-bus connection 404, a USB input support port 406, a power-over-Ethernet (POE) connector 408, retention clips 410-1, 410-2, 410-3, 410-4 (collectively, retention clips 410), and a device selector 412. In one embodiment, the band-limited array 116 may be connected to the first communication device 110 through a suitable E-bus, such as CAT5-24AWG solid conductor RJ45 cable, via the link-in E-bus connection 402. The link-out E-bus connection 404 may be used to connect the band-limited array 116 using the E-bus to another band-limited array. The E-bus may be connected to the link-out E-bus connection 404 of the band-limited array 116 and the link-in E-bus connection 402 of that another band-limited array 116. In a similar manner, multiple band-limited array s may be connected together using multiple E-buses for connecting each pair of the band-limited arrays. In an exemplary embodiment, as shown in FIG. 4B, the band-limited array 116 may be connected to a first auxiliary band-limited array 414-1 (first auxiliary array 414-1) and a second auxiliary band-limited array 414-2 (second auxiliary array 414-1) in a daisy chain arrangement. The band-limited array 116 may be connected to the first auxiliary array 414-1 using a first E-bus 416-1, and the first auxiliary array 414-1 may be connected to the second auxiliary array 414-2 using a second E-bus 416-2. The number of band-limited arrays being connected to each other (such as, to perform an intended operation with desired performance) may depend on processing capability and compatibility of a communication device, such as the first communication device 110, associated with at least one of the connected band-limited arrays.

Further, the first communication device 110 may be updated with appropriate firmware to configure the multiple band-limited arrays connected to each other or each of the band-limited arrays being separately connected to the first communication device 110. The USB input support port 406 may be configured to receive audio input signals from any compatible device using a suitable USB cable.

The band-limited array 116 may be powered through a standard POE switch or through an external POE power supply. An appropriate AC cord may be used to connect the POE power supply to the AC power. The POE cable may be plugged into the LAN+DC connection on the power supply and connected to the POE connector 408 on the band-limited array 116. After the POE cables and the E-bus(s) are plugged to the band-limited array 116, they may be secured under the cable retention clips 410.

The device selector 412 may be configured to introduce a communicating band-limited array, such as the band-limited array 116, to the first communication device 110. For example, the device selector 412 may assign a unique identity (ID) to each of the communicating band-limited arrays, such that the ID may be used by the first communication device 110 to interact or control the corresponding band-limited array. The device selector 412 may be modeled in various formats. Examples of these formats include, but are not limited to, an interactive user interface, a rotary switch, etc. In some embodiments, each assigned ID may be represented as any of the indicators such as those mentioned above for communicating to the first communication device or for displaying at the band-limited arrays. For example, each ID may be represented as hexadecimal numbers ranging from '0' to 'F'.

Figure 5:
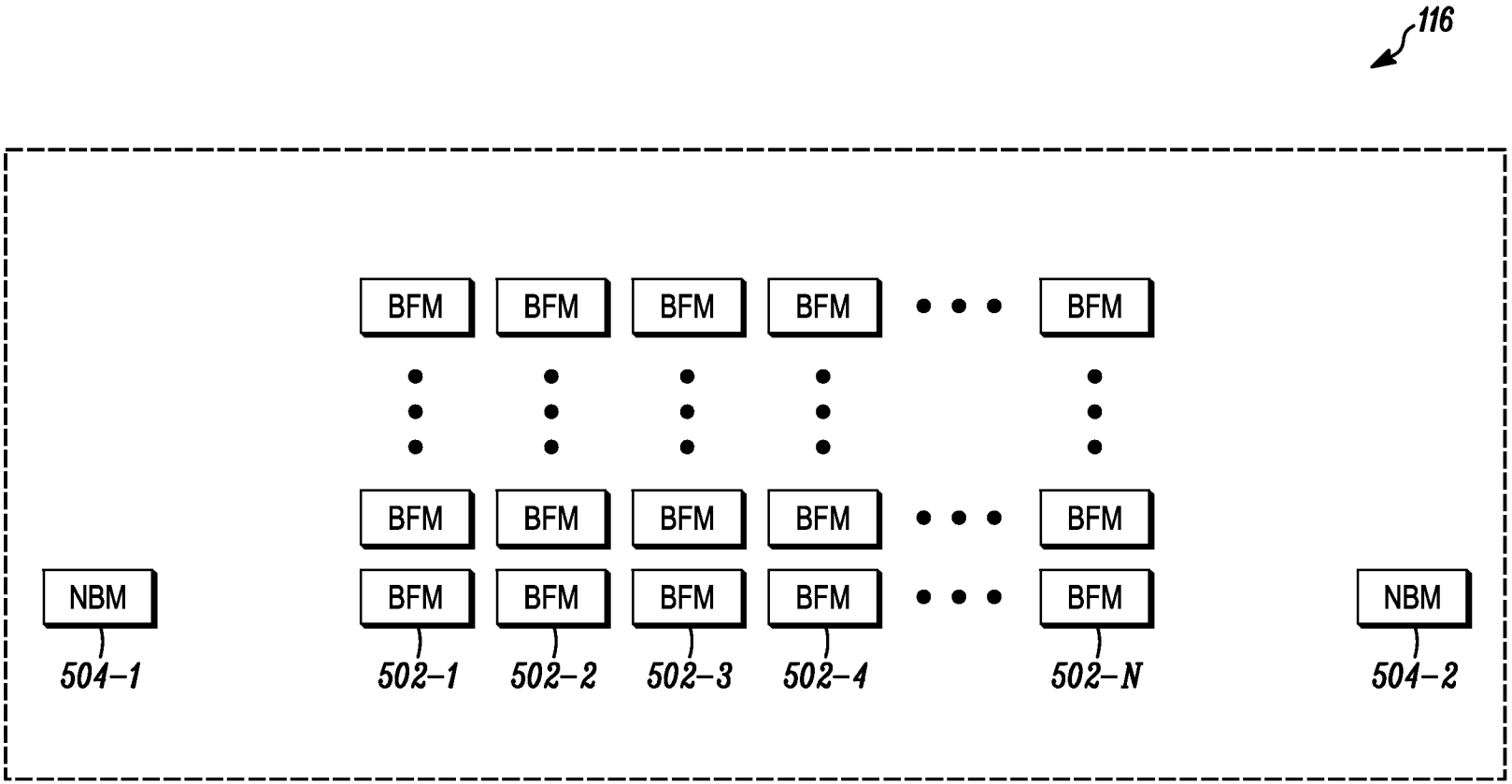
FIG. 5 is a schematic view that illustrates arrangement of microphones in the band-limited beamforming array of FIG. 1, according to an embodiment of the present disclosure.

FIG. 5 is a schematic that illustrates arrangement of microphones in the band-limited beamforming array of FIG. 1, according to an embodiment of the present disclosure. The band-limited array 116 may include a number of microphones including multiple BFMs such as 502-1, 502-2, 502-3, 502-4, **502-*n* (collectively, BFMs 502) and the NBMs 504-1 and 504-2 (collectively, NBMs 504). Each of the microphones such as the BFMs 502 and the NBMs 504 may be arranged in a predetermined pattern that facilitates maximum coverage of various sound sources in the ambient surrounding. In one embodiment, the BFMs 502 and the NBMs 504 may be arranged in a linear fashion, such that the BFMs 502 have maximum directional coverage of the surrounding sound sources. However, one of ordinary skill in the art would understand that the NBMs 504 may be arranged in various alignments with respect to the BFMs 502 based on at least one of acoustics of the ambient surrounding, such as in a room, and the desired pick-up pattern of the NBMs 504**.

Each of the microphones 502, 504 may be arranged to receive sounds from various sound sources located at a far field region and configured to convert the received sounds into audio input signals. The BFMs 502 may be configured to resolve the audio input signals within a first frequency range based on a predetermined separation between each pair of the BFMs 502. On the other hand, the NBMs 508 may be configured to resolve the audio input signals within a second frequency range. The lowest frequency of the first frequency range may be greater than the lowest frequency of the second frequency range due to unidirectional nature of the BFMs 502. Both the BFMs 502 and the NBMs 502 may be configured to operate within a low frequency range, for example, 1 Hz to 30 KHz. In one embodiment, the first frequency range corresponding to the BFMs 502 may be 150 Hz to 16 KHz, and the second frequency range corresponding to the NBMs 504 may be 20 Hz to 25 KHz. However, the pick-up pattern of the BFMs 502 may differ from that of the NBMs 504 due to their respective unidirectional and omnidirectional behaviors.

The BFMs 502 may be implemented as any one of the analog and digital microphones such as carbon microphones, fiber optic microphones, dynamic microphones, electret microphones, etc. In some embodiments, the band-limited array 116 may include at least two BFMs, though the number of BFMs may be further increased to improve the strength of desired signal in the received audio input signals. The NBMs 504 may also be implemented as a variety of microphones such as those mentioned above. In one embodiment, the NBMs 504 may be cardioid microphones placed at opposite ends of a linear arrangement of the BFMs 506 and may be oriented so that they are pointing outwards. The cardioid microphone has the highest sensitivity and directionality in the forward direction, thereby reducing unwanted background noise from being picked-up within its operating frequency range, for example, the second frequency range. Although the shown embodiment includes two NBMs 504, one with ordinary skill in the art may understand that the band-limited array 116 may be implemented using only one non-beamforming microphone.

Figure 6:
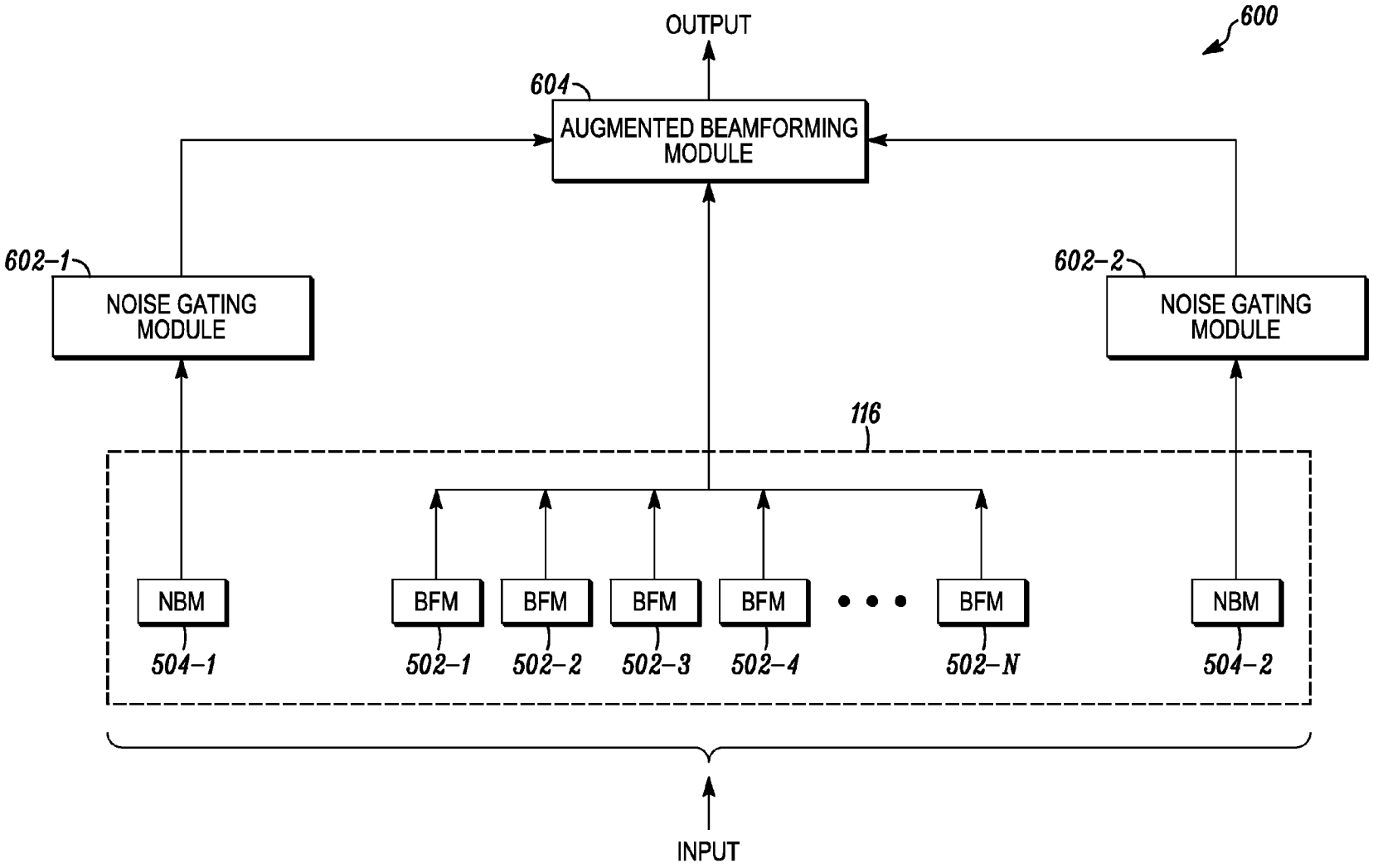
FIG. 6 is a schematic view that illustrates a system for implementing the exemplary band-limited beamforming microphone array of FIG. 1, according to an embodiment of the present disclosure.

FIG. 6 is a schematic that illustrates a system 600 for implementing the exemplary band-limited beamforming microphone array of FIG. 1, according to an embodiment of the present disclosure. The system 600 includes the band-limited array 116, noise gating modules 602-1, 602-2 (collectively, noise gating modules 602), and an augmented beamforming module 604. The band-limited array 116 may include multiple BFMs such as the BFMs 502 and the NBMs 504 arranged in a linear fashion as discussed in the description of FIG. 5. The BFMs 502 and the NBMs 504 may be configured to convert the received sounds into audio input signals.

The noise gating modules 602 may be configured to apply attenuation to the audio input signals from at least one of the NBMs 504, such as the NBM 504-1, whose directionality, i.e., gain, towards a desired sound source is relatively lesser than that of the other, such as the NBM 504-2, within the human hearing frequency range (i.e., 20 Hz to 20 KHz). In an embodiment, the noise gating modules 602 may be configured to restrict the second frequency range corresponding to the non-beamforming microphone (having lesser directionality towards a particular sound source) based on one or more threshold values. Such restricting of the second frequency range may facilitate (1) extracting the audio input signals within the human hearing frequency range, and (2) controlling the amount of each of the non-beamforming signal applied to the augmented beamforming module 504, using any one of various noise gating techniques known in the art, related art, or later developed.

Each of the one or more threshold values may be predetermined based on the intended bandpass frequency window, such as the human hearing frequency range, to perform beamforming. In one embodiment, at least one of the predetermined threshold values may be the lowest frequency or the highest frequency of the first frequency range at which the BFMs 502 are configured to operate. In one embodiment, if the threshold value is the lowest frequency (i.e., 20 Hz) of the first frequency range, the noise gating modules 602 may be configured to restrict the second frequency range between 20 Hz and 150 Hz. In another embodiment, if the threshold value is the highest frequency (i.e., 16 KHz) of the first frequency range, the noise gating modules 602 may be configured to limit the second frequency range between 16 KHz and 25 KHz.

In another embodiment, the noise gating modules 602 may be configured to restrict the second frequency range based on a first threshold value and a second threshold value. For example, if the first threshold value is the highest frequency (i.e., 16 KHz) of the first frequency range and the second threshold value is the highest frequency (i.e., 20 KHz) of the human hearing frequency range, the noise gating modules 602 may restrict the second frequency range between 16 KHz to 20 KHz. Accordingly, the noise gating modules 602 may output the audio input signals within the restricted second frequency range (hereinafter referred to as restricted audio input signals).

In some embodiments, each of the NBMs 504 may be applied with the same or different (1) threshold values, and (2) number of threshold values. The noise gating modules 602 may facilitate: (1) reducing undesired audio artifacts such as excessive noise and reverberations, and (2) reshaping the audio input signals for intended applications.

The augmented beamforming module 604 may be configured to perform beamforming on the received audio input signals within a predetermined bandpass frequency range or window. In an embodiment, the augmented beamforming module 604 may be configured to perform beamforming on the received audio input signals from the BFMs 502 within the human hearing frequency range using the restricted audio input signals from the noise gating modules 602.

The audio input signals from the BFMs 502 and the NBMs 504 may reach the augmented beamforming module 604 at a different temporal instance as the NBMs 504 as they only provide low frequency coverage. As a result, the audio input signals from the NBMs 504 may be out-of phase with respect to the audio input signals from BFMs 502. The augmented beamforming module 604 may be configured to control amplitude and phase of the received audio input signals within an augmented frequency range to perform beamforming. The augmented frequency range refers to the bandpass frequency range that is a combination of the operating first frequency range of the BFMs 502 and the restricted second frequency range generated by the noise gating modules 602.

The augmented beamforming module 604 may adjust side lobe audio levels and steering of the BFMs 502 by assigning complex weights or constants to the audio input signals within the augmented frequency range received from each of the BFMs 502. The complex constants may shift the phase and set the amplitude of the audio input signals within the augmented frequency range to perform beamforming using various beamforming techniques such as those mentioned above. Accordingly, the augmented beamforming module 604 may generate an augmented beamforming signal within the bandpass frequency range. In some embodiments, the augmented beamforming module 604 may generate multiple augmented beamforming signals based on combination of the restricted audio input signals and the audio input signals from various permutations of the BFMs 502.

The noise gating modules 602 and the augmented beamforming module 604, in one embodiment, are hardware devices with at least one processor executing machine readable program instructions for performing respective functions. Such a system may include, in whole or in part, a software application working alone or in conjunction with one or more hardware resources. Such software applications may be executed by the processors on different hardware platforms or emulated in a virtual environment. Aspects of the noise gating modules 602 and the augmented beamforming module 604 may leverage off-the-shelf software available in the art, related art, or developed later. The processor may include, for example, microprocessors, microcomputers, microcontrollers, digital signal processors, central processing units, state machines, logic circuits, and/or any devices that manipulate signals based on operational instructions. Among other capabilities, the processor may be configured to fetch and execute computer readable instructions in the memory.

This present disclosure enables the full range of human hearing to be captured and transmitted by the combined set of BFMs 502 and NBMs 504 while minimizing the physical size of the band-limited array 116, and simultaneously allowing the cost to be reduced as compared to existing beamforming array designs and approaches that perform beamforming throughout the entire frequency range of human hearing.

To summarize, this disclosure describes augmentation of a beamforming microphone array with non-beamforming microphones. One exemplary embodiment of the present disclosure includes a system for beamforming of audio input signals. The system may include a plurality of first microphones configured to resolve first audio input signals within a first frequency range, and at least one second microphone configured to resolve second audio input signals within a second frequency range. The first frequency range may have a lowest frequency greater than a lowest frequency of the second frequency range. The system may further include a noise gating module for receiving the second audio input signals. The noise gating module may be configured to restrict the second audio input signals within a restricted second frequency range, where the restricted second frequency range may extend (1) between the lowest frequency of the second frequency range and the lowest frequency of the first frequency range, or (2) between the highest frequency of the second frequency range and the highest frequency of the first frequency range. The system may also include an augmented beamforming module configured to (1) receive the restricted second audio input signals and the first audio input signals and (2) perform beamforming on the received first audio input signals and the restricted second audio input signals within a bandpass frequency range, where the bandpass frequency range can be a combination of the first frequency range and the restricted second frequency range.

Other embodiments of the present invention will be apparent to those skilled in the art after considering this disclosure or practicing the disclosed invention. The specification and examples above are exemplary only, with the true scope of the present invention being determined by the following claims.

We claim the following invention:

1. A system for beamforming of audio input signals, comprising:

a plurality of first microphones configured to resolve first audio input signals within a first frequency range;

at least one second microphone configured to resolve second audio input signals within a second frequency range, the first frequency range having a lowest frequency greater than a lowest frequency of the second frequency range;

a noise gating module configured to generate a restricted second audio input signals bound within a frequency range between the lowest frequency of the first audio input signals and the lowest frequency of the second audio input signals, or between the highest frequency of the first audio input signals and the highest frequency of the second audio input signals, said noise gating module couples to said plurality of first microphones and to said second microphones; and an augmented beamforming module that couples to said noise gating module, said augmented beamforming module is configured to:

receive the restricted second audio input signals and the first audio input signals; and perform beamforming on the received first audio input signals and the restricted second audio input signals within a bandpass frequency range, the bandpass frequency range being a combination of the first frequency range and the restricted second frequency range.

2. The claim according to claim 1, wherein the plurality of first microphones are either arranged linearly or unidirectional.

3. The claim according to claim 1, wherein the at least one second microphone is one or both of omnidirectional and cardioid microphone.

4. The claim according to claim 1, wherein the at least one second microphone is disposed outwardly away from the plurality of first microphones.

5. The claim according to claim 1, further comprising at least one third microphone configured to resolve third audio input signals within a second frequency range, wherein the at least one second microphone and the at least one third microphone are arranged on opposite ends of the plurality of first microphones.

6. A method to make a system for beamforming of audio input signals, comprising:

providing a plurality of first microphones configured to resolve first audio input signals within a first frequency range;

providing at least one second microphone configured to resolve second audio input signals within a second frequency range, the first frequency range having a lowest frequency greater than a lowest frequency of the second frequency range;

coupling a noise gating module to said plurality of first microphones and said second microphone, said a noise gating module configured to generate a restricted second audio input signals bound within a frequency range between the lowest frequency of the first audio input signals and the lowest frequency of the second audio input signals, or between the highest frequency of the first audio input signals and the highest frequency of the second audio input signals; and coupling an augmented beamforming module to said noise gating module, said augmented beamforming module is configured to:

receive the restricted second audio input signals and the first audio input signals; and perform beamforming on the received first audio input signals and the restricted second audio input signals within a bandpass frequency range, the bandpass frequency range being a combination of the first frequency range and the restricted second frequency range.

7. The claim according to claim 6, wherein the plurality of first microphones are either arranged linearly or unidirectional.

8. The claim according to claim 6, wherein the at least one second microphone is one or both of omnidirectional and cardioid microphone.

9. The claim according to claim 6, wherein the at least one second microphone is disposed outwardly away from the plurality of first microphones.

10. The claim according to claim 6, further comprising at least one third microphone configured to resolve third audio input signals within a second frequency range, wherein the at least one second microphone and the at least one third microphone are arranged on opposite ends of the plurality of first microphones.

11. A method to use a system for beamforming of audio input signals, comprising:

resolving first audio input signals within a first frequency range with a plurality of first microphones;

resolving second audio input signals within a second frequency range with at least one second microphone, the first frequency range having a lowest frequency greater than a lowest frequency of the second frequency range;

generating using a noise gating module a restricted second audio input signals bound within a frequency range between the lowest frequency of the first audio input signals and the lowest frequency of the second audio input signals, or between the highest frequency of the first audio input signals and the highest frequency of the second audio input signals, said noise gating module couples to said plurality of first microphones and to said second microphones; and using an augmented beamforming module that couples to said noise gating module, said augmented beamforming module is configured to:

receive the restricted second audio input signals and the first audio input signals; and perform beamforming on the received first audio input signals and the restricted second audio input signals within a bandpass frequency range, the bandpass frequency range being a combination of the first frequency range and the restricted second frequency range.

12. The claim according to claim 11, wherein the plurality of first microphones are either arranged linearly or unidirectional.

13. The claim according to claim 11, wherein the at least one second microphone is one or both of omnidirectional and cardioid microphone.

14. The claim according to claim 11, wherein the at least one second microphone is disposed outwardly away from the plurality of first microphones.

15. The claim according to claim 11, further comprising at least one third microphone configured to resolve third audio input signals within a second frequency range, wherein the at least one second microphone and the at least one third microphone are arranged on opposite ends of the plurality of first microphones.

16. A non-transitory program storage device readable by a computing device that tangibly embodies a program of instructions executable by the computing device to perform a method to use a system for beamforming of audio input signals, comprising:

resolving first audio input signals within a first frequency range with a plurality of first microphones;

resolving second audio input signals within a second frequency range with at least one second microphone, the first frequency range having a lowest frequency greater than a lowest frequency of the second frequency range;

generating using a noise gating module a restricted second audio input signals bound within a frequency range between the lowest frequency of the first audio input signals and the lowest frequency of the second audio input signals, or between the highest frequency of the first audio input signals and the highest frequency of the second audio input signals, said noise gating module couples to said plurality of first microphones and to said second microphones; and using an augmented beamforming module that couples to said noise gating module, said augmented beamforming module is configured to:

receive the restricted second audio input signals and the first audio input signals; and perform beamforming on the received first audio input signals and the restricted second audio input signals within a bandpass frequency range, the bandpass frequency range being a combination of the first frequency range and the restricted second frequency range.

17. The claim according to claim 16, wherein the plurality of first microphones are either arranged linearly or unidirectional.

18. The claim according to claim 16, wherein the at least one second microphone is one or both of omnidirectional and cardioid microphone.

19. The claim according to claim 16, wherein the at least one second microphone is disposed outwardly away from the plurality of first microphones.

20. The claim according to claim 16, further comprising at least one third microphone configured to resolve third audio input signals within a second frequency range, wherein the at least one second microphone and the at least one third microphone are arranged on opposite ends of the plurality of first microphones.

* * * * *